US007074242B2

(12) United States Patent
Palmer et al.

(10) Patent No.: US 7,074,242 B2
(45) Date of Patent: Jul. 11, 2006

(54) FILLING MATERIAL AND PROCESS FOR MAKING SAME

(75) Inventors: Brandon Palmer, Chicago, IL (US); Agostino Molina, Cairate (IT)

(73) Assignee: United Feather & Down, Des Plaines, IL (US)

( * ) Notice: Subject to any disclaimer, the term of this patent is extended or adjusted under 35 U.S.C. 154(b) by 124 days.

(21) Appl. No.: 10/759,610

(22) Filed: Jan. 16, 2004

(65) Prior Publication Data

US 2004/0238996 A1 Dec. 2, 2004

Related U.S. Application Data

(60) Provisional application No. 60/440,596, filed on Jan. 16, 2003.

(51) Int. Cl.

| | |
|---|---|
| ***D06L 1/16*** | (2006.01) |
| ***D06L 1/20*** | (2006.01) |
| ***A47G 9/02*** | (2006.01) |
| ***A47G 9/10*** | (2006.01) |

(52) U.S. Cl. ..... 8/137; 5/482; 5/636; 5/950; 5/951

(58) Field of Classification Search ..... 8/137; 5/482, 636, 950, 951; 442/415, 416
See application file for complete search history.

(56) References Cited

U.S. PATENT DOCUMENTS

| | | | | |
|---|---|---|---|---|
| 4,161,970 | A | 7/1979 | Lamb | |
| 5,725,821 | A | 3/1998 | Gannon et al. | |
| 6,232,249 | B1 * | 5/2001 | Kawada | 442/352 |
| 6,596,033 | B1 | 7/2003 | Luo et al. | |
| 2004/0157524 | A1 * | 8/2004 | Polat et al. | 442/390 |

FOREIGN PATENT DOCUMENTS

| | | | |
|---|---|---|---|
| EP | 1031653 | | 8/2000 |
| WO | WO 99/16705 | | 4/1999 |
| WO | WO 01/81671 | | 11/2001 |
| WO | WO 2004/023943 | * | 3/2004 |

OTHER PUBLICATIONS

Eichinger et al., "Lenzing lyocell fill filling fiber for bedding," Chemical Fibers International (2002) 52 (1) 36-38.*
FactSheet, Ohio State University Extension Fact Sheet, Consumer and Textile Sciences, Lyocell—One Fiber, Many Faces, pp. 1-5, 1999.
Lenzing Lyocell Fill Filling Fiber For Bedding; D. Eichinger, J. Manner, W. Feilmair, P. Kruger; Chemical Fibers Internation, vol. 52, Feb. 2002; pp. 36-37.

* cited by examiner

*Primary Examiner*—Margaret Einsmann
(74) *Attorney, Agent, or Firm*—Cowan Liebowitz & Latman, P.C.; Mark Montague

(57) ABSTRACT

A filling material for use with pillows, comforters and other products includes a blend of down and Lyocell fiber. Various preparation, washing, drying, dedusting, and blending steps achieve the blended product. The filling material has various advantageous characteristics such as improved moisture management, improved support while maintaining softness and comfort, and all-natural and enhanced hypoallergenic performance.

24 Claims, 1 Drawing Sheet

FILLING MATERIAL AND PROCESS FOR MAKING SAME

RELATED APPLICATION

This application claims the benefit of U.S. Provisional Application Ser. No. 60/440,596, filed Jan. 16, 2003.

FIELD OF THE INVENTION

The present invention relates to a filling material and process for making the filling material and, more particularly, to a filling material produced from down and Lyocell fiber and a process for manufacturing same.

BACKGROUND OF THE INVENTION

Down, which grows next to the body of a goose or duck and beneath the feathers, is the well know soft fluffy fiber undercoating that traps the body's natural warmth. Down is used in a multitude of products, including pillows, comforters, bedding, jackets, and so on. Down provides a superior level of comfort and warmth as compared to most other natural and synthetic fibers. In particular, down is an excellent fiber for wicking away moisture while retaining body warmth. Even so, improvements to the field, whether it be increased moisture management, increased comfort, increased support, etc., are still possible.

OBJECTS AND SUMMARY OF THE INVENTION

It is therefore an object of the present invention to manufacture and provide a filling material that has increased moisture management as compared to existing materials.

It is a further object to provide a filling material that is soft, yet provides support.

It is another object to provide a filling material that is all natural that contains has the above-mentioned advantageous characteristics.

It is yet a further object to provide a filling material that has enhanced hypoallergenic performance as compared to existing materials.

To attain the above-stated objectives, a filling material is comprised of a combination of down and Lyocell fiber, and a method of manufacturing the filling material is comprised of the steps of washing the down in accordance with a predetermined washing process to produce prepared down, and blending the prepared down with the Lyocell fiber in accordance with a predetermined blending process to produce the filling material.

As a feature of the invention, blending is carried out by blending the down 70% by weight with 30% by weight Lyocell fiber.

As another feature, various washing and rinsing steps are carried out to produce the prepared down, and various washing and rinsing steps are applied during mixing of the down with the Lyocell fiber.

As a further feature, 40 pounds of the blended mixture are dried at a time for 20 minutes at a temperature of 200 degrees Fahrenheit.

Various other objects, advantages and features of the present invention will become readily apparent to those of ordinary skill in the art, and the novel features will be particularly pointed out in the appended claims.

BRIEF DESCRIPTION OF THE DRAWINGS

The following detailed description, given by way of example and not intended to limit the present invention solely thereto, will best be appreciated in conjunction with the accompanying drawing, in which.

DETAILED DESCRIPTION OF THE INVENTION

Figure 1:
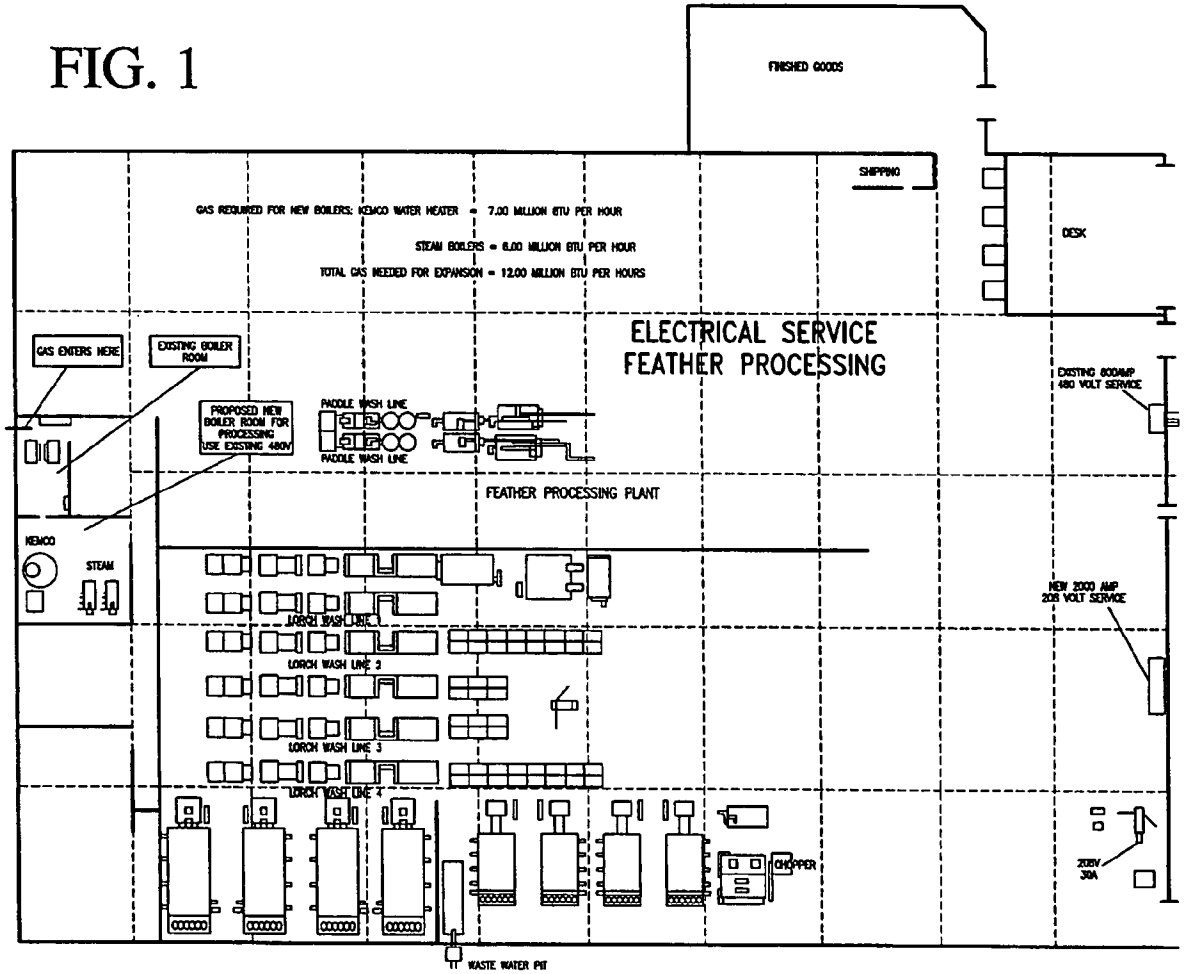
FIG. 1 is a schematic illustration of a facility suitable for producing Lyocell Down of the present invention.

The filling material of the present invention is a combination of down and Lyocell fiber, as herein described. Down is the well known waterfowl plumage and is used in many products that relate to warmth and comfort. Lyocell fiber is a wood pulp derivative fiber produced for eucalyptus trees. For convenience herein, the inventive filling material will be referred to as Lyocell Down.

As further discussed below, Lyocell Down is a blend of down comprised of a minimum of 75% net down cluster and 100% Lyocell fiber. To produce Lyocell Down, the down is first prepared, and then the prepared down is blended with Lyocell fiber. As would be appreciated, FIG. 1 is a schematic illustration of an exemplary facility suitable for producing Lyocell Down of the present invention.

The down is prepared by first sorting the original waterfowl plumage. As is known, plumage from waterfowl is a combination of down, feathers, fibers, and residue. These components are separated using any known sorting process. For example, since each of these components is different in weight and structure, a sorting machine using air chambers is able to separate the various components by weight. Only the down component is utilized in the production of Lyocell Down. Next, the down is washed. Dirt, dust and impurities are removed in the washing process. During the washing process, the down goes through a washing production line that includes a feeding silo, where the material loading and loosening occurs. Washing then occurs by use of known washing machines. This may include a stainless steel drum with variable speed drive perforated screen and continual rinse and drainage capability. A discharging silo is then utilized to hold the wet and washed material and to regulate the amount of washed material that is fed to the dryer, generally a steam pressure vessel with a ventilated opening to trap excess dust and fiber. Once dried, the down is supplied to a cooler/deduster, which generally is a screen steel drum that agitates the down to release any remaining residue and, further, cools the down. The resulting down is then supplied to individual packing stations (Pack Out Boxes).

The above-described washing/drying and dedusting/cooling process has been generally described. In a particularly preferred embodiment of the present invention, the washing process is carried out as provided in the following steps:

1. Down is loaded into feeding silo.
2. The feeding silo discharges down to a washer.
3. The down is washed for 40 minutes (e.g., with an industrial WS5 washing line with modified screens, drives and filtration systems), and includes the following subcycles: (a) the down is washed in hot soapy water, preferably at a temperature of 120 degrees Fahrenheit; (b) the washed down goes through a centrifuge cycle to drain excess water; (c) the down goes through a hot water rinse; (d) the down goes through another centrifuge cycle; (e) the down goes through a cold water rinse; (f) the down goes through another centrifuge cycle; (g) another cold water rinse is provided; (h) another centrifuge cycle is provided; and (i) the down is discharged to a discharging silo.

4. The washed down is dried in a dryer, and includes the following sub-steps: (a) the discharge silo feeds the washed down to the dryer in increments of 40 lbs; (b) the supplied down is dried by the dryer for 20 minutes at a temperature of 220 degrees Fahrenheit; and (c) the dryer discharges the now-dried down to a deduster/cooler.

5. The deduster/cooler carries out the following sub-steps: (a) dedusting of the down within a screened centrifuge and vacuum system; (b) cooling the down; (c) the injection of ozone into the down; and (d) discharge of the down to pack out boxes.

The down as prepared as described above is blended with Lyocell fiber in accordance with the present invention in the manner as follows. As mentioned above, Lyocell Down of the present invention is comprised of a blend of 70% down, with a minimum of 75% net down cluster, and 100% Lyocell fiber, with an 11 mm 6.7 deci-tex.

The inventive Lyocell Down is produced by the following described wet blending process:

1. The now-washed/dried/dedusted/cooled down is loaded into a feeding silo 70% by weight. For example, if the production load is 100 lbs. of dry weight, then the down portion is 70 lbs.

2. The down is discharged from the silo to a washing machine. Within the washing machine, the following sub-steps are carried out: (a) the down is washed in hot soapy water; (b) the down enters a centrifuge cycle; (c) a hot water rinse cycle is carried out; (d) another centrifuge cycle is carried out; (e) 30% by weight Lyocell fiber is added directly to the washing machine; (f) the down and Lyocell fiber are mixed during a cold water rinse; (g) the mixture goes through a centrifuge cycle; (h) the mixture is further blended during another cold water rinse; (i) the mixture again goes through another centrifuge cycle; (j) the mixture goes through another cold water rinse; (k) again through a further centrifuge cycle; and (l) then discharged to a discharging silo.

3. The down combined with the Lyocell is dried in the following manner: (a) the discharge silo feeds the dryer in increments of 40 lbs; (b) the dryer dries the down/Lyocell mix for 20 minutes at a temperature of 220 degrees Fahrenheit; (c) the dryer discharges to the product to a cooler/deduster; (d) the cooler/deduster dedusts the product within a screened centrifuge; (e) the product is cooled; (f) ozone is injected into the product; (g) and the product, now the produced Lyocell Down, is discharge to pack out boxes.

As described above, and in accordance with the present invention, down and Lyocell are mixed in a particular manner. The particular mixing process is a component of the inventive process. In particular, such process of blending the Lyocell fiber with down, as previously discussed, was derived through numerous trials. The Lyocell was blended in at various stages of the process throughout the trials. Many such trials resulted in a blending too early in the process that resulted in twisting of the fiber, which in turn impairs quality and performance. Thus, the herein-described process provides the known best mode for carrying out the invention.

In addition, the use of the above-mentioned 11 mm 6.7 deci-tex Lyocell fiber is the preferred length and thickness. Other variations of Lyocell fiber were found to result in lower blending performance.

The above-described Lyocell Down and process of making Lyocell Down has been described as using 70% by weight down with 30% by weight Lyocell. However, other variations of Lyocell Down are possible. For example, the blend can be adjusted by weight for different compositions of Lyocell Down. This includes: 10% down and 90% Lyocell fiber; 20% down and 80% Lyocell fiber; 30% down and 70% Lyocell fiber; 40% down and 60% Lyocell fiber; 50% down and 50% Lyocell fiber; 60% down and 40% Lyocell fiber; 80% down and 20% Lyocell fiber; and 90% down and 10% Lyocell fiber. Other variations, such as, for example, 63% down and 37% Lyocell fiber are also possible.

Still further, the down and Lyocell fiber may be blended together in a manner different from that described above. In particular, blending may occur in a dry process where the down is taken after the completed wash cycles and blended with Lyocell fiber in a mixing machine. An appropriate mixing machine includes one with two shafts with attached paddles that rotate in opposite directions. In addition, the above-described wet blending process may be modified by adjusting cycle times, varying the number of rinses, as well as the rinsing and drying temperatures.

In accordance with the present invention, the inventive Lyocell Down product has various advantageous characteristics. In particular, Lyocell Down has increased moisture management. While down by itself is an excellent fiber for wicking away moisture while retaining body warmth, Lyocell Down improves upon this feature and provides improved warmth and comfort. Lyocell down has a greater fiber density as compared to down. The increased fiber density in turn provides better support, while at the same time, maintains comfort. For example, in the case of down pillows, such items provide extreme comfort and softness to the user, but they often lack sufficient support. Lyocell down, on the other hand, maintains comfort and softness, with the added feature of provided improved support.

Lyocell Down is all natural. Many down alternatives seek to mimic or allegedly improve upon down, but many are not all natural. Generally, such fibers are polyester based and thus are not all-natural and, further, usually do not provide the user with the comfort and feel of Down. Lyocell Down is a combination of Down and Lyocell, both natural fibers. Their resultant combination provides a result that improves upon the natural characteristics of down, something that is not achieved by synthetic materials.

Lyocell Down also has enhanced hypoallergenic performance. That is, the elimination of dust and residue in the above-described process, thus resulting with only pure down and Lyocell, eliminates or at least minimizes allergic reactions. Thus, the inventive product as herein described is quite advantageous to allergy sufferers.

Upon production of the Lyocell Down of the present invention, various products may be manufactured with the produced Lyocell Down. In particular, bedding, pillows, comforters and the like are filled with the inventive Lyocell Down to produce products that have the characteristics and qualities mentioned above. Since it is within the knowledge of those of ordinary skill in the art to produce pillows, comforters, etc., a description thereof is not provided herein. However, such products being filled with Lyocell Down are incorporated within the invention herein-described.

In view of the foregoing discussion which describes the inventive product of Lyocell Down and the inventive process for making such a process, it is intended that the appended claims be interpreted as including the embodiments described herein, the alternatives mentioned above, and all equivalents thereto.

What is claimed is:

1. A method of manufacturing a filling material, comprising the steps of:

obtaining down;

washing the down in accordance with a predetermined washing process to produce prepared down;

obtaining Lyocell fiber;

blending the prepared down with the obtained Lyocell fiber in accordance with a predetermined blending process to produce the filling material.

2. The method of claim 1, wherein the blending step is carried out by blending the prepared down 70% by weight with 30% by weight Lyocell fiber.

3. The method of claim 1, wherein the washing step is carried out by the sub-steps of:

(a) washing the down with hot soapy water;

(b) rinsing the down with hot water;

(c) rinsing the down with cold water;

(d) drying the rinsed down; and (e) dedusting and cooling the dried down.

4. The method of claim 3, wherein the drying sub-step is carried out by drying 40 pounds of washed down for substantially 20 minutes at a temperature of substantially 220 degrees Fahrenheit.

5. The method of claim 3, wherein the dedusting and cooling sub-step further includes injecting ozone into the down.

6. The method of claim 3, wherein the dedusting and cooling sub-step is carried out utilizing a screened centrifuge.

7. The method of claim 3, wherein each of the washing and two rinsing sub-steps further includes applying the down to a centrifuge cycle.

8. The method of claim 1, wherein the blending step is carried out by the sub-steps of:

(a) washing the down with hot soapy water;

(b) rinsing the down with hot water;

(c) adding the Lyocell fiber to the washed and rinsed down to produce a mixture;

(d) rinsing the mixture with cold water;

(e) drying the rinsed mixture; and (f) dedusting and cooling the dried mixture.

9. The method of claim 8, wherein the rinsing the mixture sub-step includes applying the rinsed mixture to a centrifuge cycle, and repeating the rinsing and centrifuge cycles multiple times.

10. The method of claim 8, wherein the adding sub-step is carried out by adding 30% by weight Lyocell fiber to the washed and rinsed down.

11. The method of claim 8, wherein the drying sub-step is carried out by drying substantially 40 pounds of the rinsed mixture for substantially 20 minutes at a temperature of substantially 200 degrees Fahrenheit.

12. The method of claim 8, wherein the dedusting and cooling sub-step includes injecting of ozone into the dried mixture.

13. The method of claim 1, wherein the blending step is carried out by a dry process.

14. The method of claim 1, further comprising the step of filling a pillow with the produced filling material.

15. The method of claim 1, further comprising the step of filling a comforter with the produced filling material.

16. A filling material, comprising:

down; and

Lyocell fiber blended with the down.

17. The filling material of claim 16, wherein the filling material includes 70% by weight of the down and 30% by weight of the Lyocell fiber.

18. The filling material of claim 16, wherein the down includes a minimum of 75% new down cluster.

19. A pillow, comprising:

a blend of down and Lyocell fiber; and a pillow filled with the blend of down and Lyocell fiber.

20. A comforter, comprising:

a blend of down and Lyocell fiber; and a comforter filled with the blend of down and Lyocell fiber.

21. A method of manufacturing a filling material, comprising the steps of:

obtaining down;

obtaining Lyocell fiber;

blending the obtained down with the obtained Lyocell fiber to produce the filling material.

22. The method of claim 21, further comprising filling a pillow with the produced filling material.

23. The method of claim 21, further comprising filling a comforter with the produced filling material.

24. The method of claim 21, wherein the blending step is carried out by blending the obtained down with the obtained Lyocell fiber using a wet blending process to produce the filling material.

* * * * *